US006515421B2

(12) United States Patent
Dietrich et al.

(10) Patent No.: US 6,515,421 B2
(45) **Date of Patent: *Feb. 4, 2003**

(54) CONTROL OF LEACHABLE MERCURY IN FLUORESCENT LAMPS

(75) Inventors: David Key Dietrich, Schenectady, NY (US); Deborah Ann Haitko, Schenectady, NY (US)

(73) Assignee: General Electric Company, Niskayuna, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/389,118

(22) Filed: Sep. 2, 1999

(65) Prior Publication Data

US 2001/0020823 A1 Sep. 13, 2001

(51) Int. Cl.[7] ..... H01J 17/02; H01J 61/02

(52) U.S. Cl. ..... 313/626; 313/624; 313/317; 313/634; 313/635; 313/318.01; 445/14

(58) Field of Search ..... 313/634, 635, 313/636, 639, 640, 492, 493, 631, 345, 565, 490, 284, 318.01, 318.04, 318.05, 318.06, 318.07, 318.08, 318.09, 318.1, 318.11, 318.12, 623, 626, 566, 346 R; 445/14

(56) References Cited

U.S. PATENT DOCUMENTS

| | | | | | |
|---|---|---|---|---|---|
| 2,332,090 | A | | 10/1943 | Knochel et al. | 313/318.01 |
| 2,873,510 | A | | 2/1959 | Duran et al. | 313/318.01 |
| 3,991,337 | A | | 11/1976 | Notelteirs | 313/332 |
| 4,015,165 | A | * | 3/1977 | Hardies | 313/318 |
| 4,171,500 | A | | 10/1979 | van Lieshout | 313/332 |
| 4,324,998 | A | | 4/1982 | Gilmore et al. | 313/318 |
| 4,739,219 | A | * | 4/1988 | Hume | 313/623 |
| 5,229,686 | A | | 7/1993 | Fowler et al. | |
| 5,229,687 | A | | 7/1993 | Fowler et al. | |
| 5,272,409 | A | * | 12/1993 | Van Dulmen et al. | 313/113 |
| 5,585,694 | A | * | 12/1996 | Goldburt et al. | 313/346 R |
| 5,663,607 | A | * | 9/1997 | Kira et al. | 313/284 |
| 5,754,002 | A | | 5/1998 | Haitko et al. | |
| 5,777,434 | A | * | 7/1998 | Dietrich et al. | 313/565 |
| 5,825,127 | A | * | 10/1998 | Weinhardt | 313/560 |
| 5,876,205 | A | * | 3/1999 | Schiabel et al. | 313/490 |
| 5,898,265 | A | * | 4/1999 | Woodward et al. | 313/565 |
| 5,932,955 | A | * | 8/1999 | Berger et al. | 313/493 |
| 5,949,189 | A | * | 9/1999 | Foust et al. | 313/565 |
| 5,952,780 | A | * | 9/1999 | Forsdyke et al. | 313/565 |
| 5,998,925 | A | * | 12/1999 | Shimizu et al. | 313/503 |
| 6,011,353 | A | * | 1/2000 | Rachel et al. | 313/318.05 |

FOREIGN PATENT DOCUMENTS

| | | |
|---|---|---|
| JP | 09274894 A | 10/1997 |

* cited by examiner

*Primary Examiner*—Nimeshkumar D. Patel
*Assistant Examiner*—Mariceli Santiago
(74) *Attorney, Agent, or Firm*—Bernadette Bennett; Noreen C. Johnson

(57) ABSTRACT

A method and apparatus for preventing the formation of leachable mercury in mercury arc vapor discharge lamps which comprises coating at least one of the metallic components of the mercury arc vapor discharge lamps with at least one noble metal coating.

26 Claims, 2 Drawing Sheets

CONTROL OF LEACHABLE MERCURY IN FLUORESCENT LAMPS

BACKGROUND OF THE INVENTION

The present invention relates to a method and apparatus for preventing the formation of leachable mercury in mercury arc vapor discharge lamps. More particularly, the present invention relates to a method and apparatus for preventing the formation of leachable mercury that involves coating metallic components in mercury arc vapor discharge lamps with at least one noble metal coating.

Mercury arc vapor discharge lamps, otherwise commonly known as fluorescent lamps, are standard lighting means. The mercury arc vapor discharge lamp consists of metallic components such as lead wires, connector pins and end caps. The lead wires and portions of the end cap and connector pins are surrounded by a glass enclosure. The interior of the glass enclosure is typically coated with phosphor. Elemental mercury is added to the mercury arc vapor discharge lamp and typically, the elemental mercury adheres to the phosphor. In certain conditions, it has been found that when elemental mercury comes in contact with the metal components in a lamp such as copper and iron containing lead wires, brass pins, or other associated metallic mount components, the elemental mercury is transformed into a leachable form.

In order to address the growing concern that mercury from disposal of fluorescent lamps might leach into surface and subsurface water, the Environmental Protection Agency has established a maximum concentration level for mercury at 0.2 milligrams of leachable mercury per liter of extract fluid. The concentration level for mercury is generally determined by a standard analysis known as the Toxicity Characteristic Leaching Procedure (TCLP), a well known test procedure.

When carrying out the TCLP test, test lamps are pulverized to form lamp waste material similar to that which would result from lamp disposal in land fills or other disposal locations. The ambient conditions in disposal locations may be such as to promote formation of leachable mercury. The TCLP test conditions themselves tend to allow for formation of leachable mercury in amounts greater than the established limit of 0.2 milligrams per liter.

During the disposal of the lamp, and in the TCLP test, the glass enclosure of the lamp is broken. Elemental mercury that is contained in the lamp is then exposed to the metal components in an aqueous environment. Elemental mercury, when exposed to both the metal components and the aqueous environment, is oxidized to leachable mercury. The metal components in the lamp provide the source of oxidizable iron and oxidizable copper which promotes the formation of leachable mercury.

Several techniques have been developed which prevent the formation of mercury which can leach into the environment. The methods currently used are concerned with a method of delivering a chemical agent or metal upon disposal of a lamp or during the TCLP test. For instance, Fowler et al. (U.S. Pat. No. 5,229,686 and U.S. Pat. No. 5,229,687) describe methods which incorporate chemical agents in the lamp in either a glass capsule or the basing cement. These chemical agents include various salts such as bromide anions, chloride anions, iodide anions, iodate anions, periodate anions, and sulfide anions, to name a few. Other chemical agents include powders such as iron powder, copper powder, tin powder, and titanium powder.

Generally, any modification of the lamp components are driven by the need to decrease the amount of leachable mercury. Unfortunately, the current methods are concerned with a method of delivery to add significant amounts of a chemical or a metal in the lamp. In addition, the method of delivery of the chemical agents typically modify the lamp design. Thus, methods have yet to be devised which improve the existing components to decrease the amount of leachable mercury.

SUMMARY OF THE INVENTION

The invention provides a method and articles made thereby for preventing the formation of leachable mercury in mercury vapor discharge lamps. The method includes coating at least one of the metallic components in the mercury vapor discharge lamp with at least one noble metal coating.

DETAILED DESCRIPTION

Figure 1:
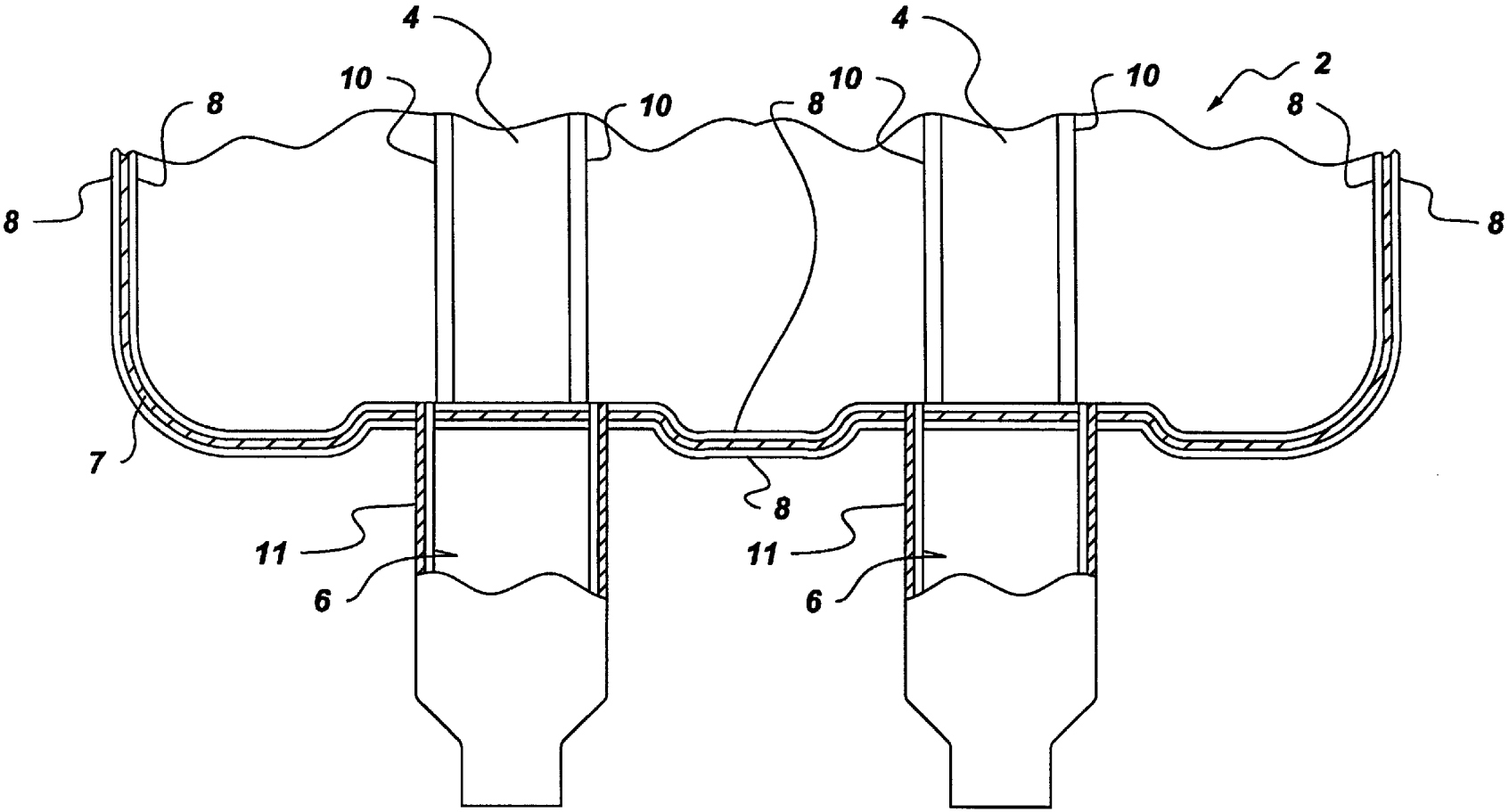
FIG. 1 is a side view of the end cap of a mercury arc vapor discharge lamp in accordance with one embodiment of the present invention.

The incorporation of metal components which are coated with at least one noble metal coating in a lamp structure has been found to have a significant effect on preventing mercury compounds from leaching during the TCLP test. Metal components of the lamp which are coated include the lead wires, connectors pins, end caps, or combinations thereof. Accordingly, the formation and dissolution of soluble ferric and cuprous ions from the mercury vapor arc discharge lamp components is diminished or prevented resulting in reduction or prevention of leachable mercury compounds.

Lead wires are typically made of iron or copper and connector pins are typically made of brass. The lead wires and connectors pins are the source of elemental iron ($Fe^0$) and copper ($Cu^0$) which is oxidized in the presence of oxygen and an aqueous environment to ferric ($Fe^{+3}$) and cuprous ($Cu^{+1}$) ions. Ferric and cuprous ions can then dissolve in aqueous solution. The presence of ferric and cuprous compounds has been found to lead to the formation of leachable mercury.

"Leachable mercury" as used herein refers to elemental mercury ($Hg^0$) which has been oxidized. Oxidized mercury reacts with oxygen to form compounds such as mercuric oxide (HgO). Once the lamp has been broken and the elemental mercury can oxidize to leachable mercury, the leachable mercury can be carried via groundwater, rivers and streams.

"Noble metal coating" as used herein refers to a coating of gold, silver, palladium, copper, nickel, or combinations thereof, on at least one of the metal components which is found in a mercury arc vapor discharge lamp.

A flash coat of a noble metal is applied to the metal components of the lamp. The term "flash coat", as used herein refers to a thin coating which has a thickness in a range between about 0.03 to about 1.3 microns and alternatively, in a range between about 0.1 microns and about 0.2 microns. The flash coating of the noble metal coating is applied via a standard electrochemical plating method. With this coating method, the metal component of the lamp is dipped in a solution of a noble metal. Less than 200 milligrams of the metal coating is deposited on the metal component of the lamp.

The present invention provides at least one noble metal coating on the metallic components of the mercury arc vapor discharge lamp. The metallic components of the mercury arc vapor discharge lamp in the present invention include, but are not limited to, at least one noble metal coating. The present invention includes multiple noble metal coatings.

Noble metals do not oxidize as readily as brass, iron or copper. It has been found that the noble metal coating reduces the dissolution of ferric iron and cuprous copper on the surface which is coated. The coating thereby decreases the availability of exposed iron and copper in a disposed lamp thus lessening the amount of leachable mercury which is formed and lessens the chance of the oxidized mercury leaching within a landfill. The ability of noble metals to decrease the interaction of mercury with other oxidizing metals in the lamp system such as ferric iron and cuprous copper is supplemented by the ability of noble metals to amalgamate elemental mercury to further prevent dissolution to a leachable form.

Providing a metallic lamp component which is coated with a noble metal coating in a mercury arc vapor discharge lamp reduces the formation of leachable mercury. The present invention increases the kinetic rate of the elemental mercury binding to the noble metal coated components during the TCLP test. In addition, the noble metal coating improves electrical contact between the various metal components.

Referring to the drawings with more particularity, FIG. 1 illustrates the end cap 7 and the metallic components of a mercury arc vapor discharge 2 lamp which is noble metal coated. In one embodiment, a single layer noble metal coating is disposed over portions of the metallic components of a mercury arc vapor discharge lamp. As shown in FIG. 1, the apparatus end cap 7 has metal coating 8, the connector pins 6 have a metal coating 11, and lead wires 4 have a metal coating 10.

Figure 2:
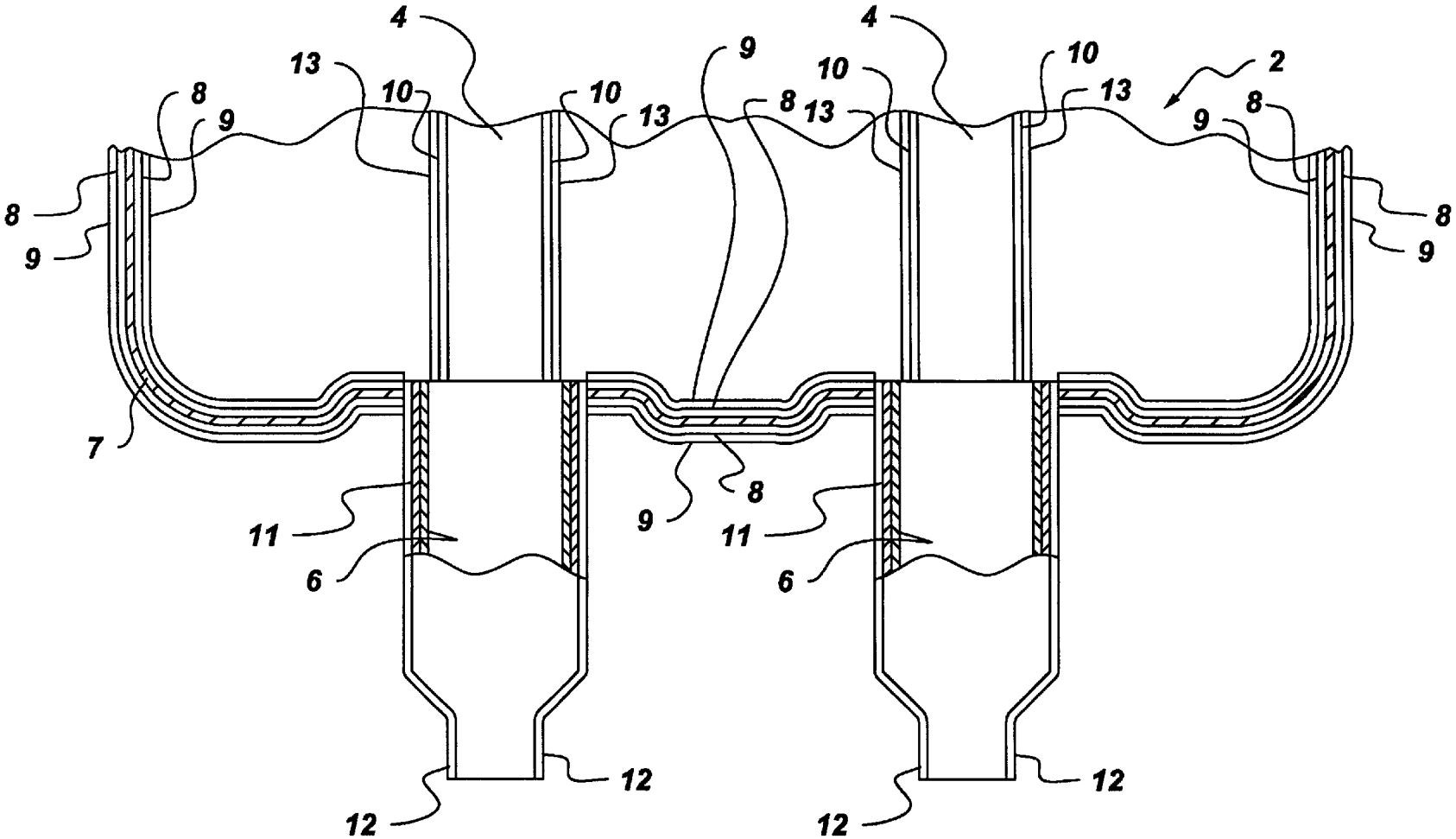
FIG. 2 is a side view of the end cap of a mercury arc vapor discharge lamp in accordance with a second embodiment of the present invention.

FIG. 2 illustrates a second embodiment of the present invention wherein the end cap 7 and the metallic components of a mercury arc vapor discharge 2 are noble metal coated with two coatings. As shown in FIG. 2, the apparatus end cap 7 has a first metal coating 8 and a second metal coating 9, the connector pins 6 have a first metal coating 11 and a second metal coating 12, and lead wires 4 have a first metal coating 10 and a second metal coating 13.

The invention is illustrated by testing of mercury vapor arc discharge lamps via the TCLP test in which certain metallic components of the mercury arc vapor discharge lamp are coated with a noble metal coating. These examples are to be regarded as non-limiting.

All TCLP test data was obtained by the test procedure prescribed on pages 26987–26998, volume 55, number 126 of Jun. 29, 1990 issue of the Federal Register.

Briefly, lamps being tested with the TCLP test were pulverized into particulate form having the prescribed particle size which is capable of passing through a ⅜ inch sieve. The test material was then extracted with a sodium acetate-acetic acid buffer at a pH of about 4.93.

To prevent the formation of leachable mercury of mercury vapor discharge lamps during the TCLP test, gold coated connector were used to controlled the formation of leachable mercury. The connector pins had a gold coating with a thickness in a range between about 0.1 microns and about 0.2 microns. During the TCLP test, various amounts of mercury were manually added. Leachable mercury was then measured to determine the effects the gold coating on brass pins. The results of the amount of leachable mercury formed using metal components coated and non-coated can be seen in Table 1.

TABLE 1

| Manual mercury dose (mg) | Leachable Hg without Coated Pins | Leachable Hg with Gold Coated Pins |
|---|---|---|
| 0 | 0 ppb | 0 ppb |
| 5 | 65 ppb | 50 ppb |
| 10 | 140 ppb | 85 ppb |
| 15 | 195 ppb | 100 ppb |
| 20 | 600 ppb | 189 ppb |

When the brass pins are coated with a first coating of palladium and a second coating of gold, the effect of the two coatings on the formation of leachable mercury during the TCLP test is evident from the data in Table 2. The first coating is a palladium coating. The palladium coating is coated on the connector pins with a thickness in a range between about 0.2 microns and about 0.3 microns. The second coating is a gold coating. The gold coating is coated on the connector pins with a thickness in a range between about 0.1 microns and about 0.2 microns.

TABLE 2

| Manual mercury dose (mg) | Leachable Mercury with Palladium and Gold Coated Pins |
|---|---|
| 0 | 0 ppb |
| 5 | 105 ppb |
| 10 | 119 ppb |
| 15 | 172 ppb |
| 20 | 167 ppb |

It is evident from the results shown in Table 1 and Table 2 that noble metal coated connector pins effectively decreased the amount of leachable mercury formed during the TCLP test. As the mercury dose was increased, it is apparent that the amount of leachable mercury decreased with the use of gold coated brass pins and the use of palladium and gold coated brass pins.

Even after the lamp is broken, the noble metal coating provides a robust method for reducing the amount of leachable mercury. The noble metal coating amalgamates mercury to reduce the amount of leachable mercury. The present invention does not require the addition of large quantities of a powder or chemical agent to the mercury arc discharge lamp structure. Rather, the present invention enhances the already existing components to reduce the amount of leachable mercury.

While embodiments have been shown and described, various modifications and substitutions may be made thereto without departing from the spirit and the scope of the invention. Accordingly, it is to be understood that the present invention has been described by way of illustration and not limitation.

What is claimed is:

1. A mercury vapor discharge lamp comprising at least one copper or iron outer lead wire coated with at least one coating of silver, palladium, or combinations thereof.

2. The lamp according to claim 1 wherein said coating has a thickness in a range between about 0.03 microns and about 1.3 microns.

3. The lamp according to claim 1 wherein said coating has a thickness in a range between about 0.1 microns and about 0.2 microns.

4. A mercury vapor discharge lamp comprising at least one brass connector pin coated with at least one coating of silver, palladium, nickel or combinations thereof.

5. The lamp according to claim 4 wherein said coating has a thickness in a range between about 0.03 microns and about 1.3 microns.

6. The lamp according to claim 4 wherein said coating has a thickness in a range between about 0.1 microns and about 0.2 microns.

7. A mercury vapor discharge lamp comprising at least one copper or iron outer lead wire coated with a first and second coating, each coating being of silver, palladium, or combinations thereof.

8. The lamp according to claim 7 wherein said second coating has a thickness in a range between about 0.03 microns and about 1.3 microns.

9. The lamp according to claim 7 wherein said second coating has a thickness in a range between about 0.1 microns and about 0.2 microns.

10. A mercury vapor discharge lamp comprising at least one brass connector pin coated with a first and second coating, each coating being of silver, palladium, nickel or combinations thereof.

11. The lamp according to claim 10 wherein said second coating has a thickness in a range between about 0.03 microns and about 1.3 microns.

12. The lamp according to claim 10 wherein said second coating has a thickness in a range between about 0.1 microns and about 0.2 microns.

13. A mercury vapor discharge lamp comprising at least one brass connector pin having a palladium coating with a thickness in a range between about 0.1 microns and about 0.2 microns.

14. A method for preventing the formation of leachable mercury compounds in mercury vapor discharge lamps which comprises providing in the lamp structure at least one copper or iron outer lead wire coated with at least one coating of silver, palladium, or combinations thereof.

15. The method according to claim 14 wherein said coating has a thickness in a range between about 0.03 microns and about 1.3 microns.

16. The method according to claim 14 wherein said coating has a thickness in a range between about 0.1 microns and about 0.2 microns.

17. A method for preventing the formation of leachable mercury compounds in mercury vapor discharge lamps which comprises providing in the lamp structure at least one brass connector pin coated with at least one coating of silver, palladium, nickel or combinations thereof.

18. The method according to claim 17 wherein said coating has a thickness in a range between about 0.03 microns and about 1.3 microns.

19. The method according to claim 17 wherein said coating has a thickness in a range between about 0.1 microns and about 0.2 microns.

20. A method for preventing the formation of leachable mercury compounds in mercury vapor discharge lamps which comprises providing in the lamp structure at least one copper or iron outer lead wire coated with a first and second coating, each coating being of silver, palladium, or combinations thereof.

21. The method according to claim 20 wherein said second coating has a thickness in a range between about 0.03 microns and about 1.3 microns.

22. The method according to claim 20 wherein said second coating has a thickness in a range between about 0.1 microns and about 0.2 microns.

23. A method for preventing the formation of leachable mercury compounds in mercury vapor discharge lamps which comprises providing in the lamp structure at least one brass connector pin coated with a first and second coating, each coating being of silver, palladium, nickel or combinations thereof.

24. The method according to claim 23 wherein said second coating has a thickness in a range between about 0.03 microns and about 1.3 microns.

25. The method according to claim 23 wherein said second coating has a thickness in a range between about 0.1 microns and about 0.2 microns.

26. A method for preventing the formation of leachable mercury compounds in mercury vapor discharge lamps which comprises providing in the lamp structure comprising at least one brass connector pin having a palladium coating with a thickness in a range between about 0.1 microns and about 0.2 microns.

* * * * *